US009144981B2

(12) United States Patent
Saikawa

(10) Patent No.: US 9,144,981 B2
(45) Date of Patent: Sep. 29, 2015

(54) LIQUID EJECTION HEAD AND LIQUID EJECTION APPARATUS

(75) Inventor: Akihisa Saikawa, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 310 days.

(21) Appl. No.: 13/190,353

(22) Filed: Jul. 25, 2011

(65) Prior Publication Data

US 2012/0026243 A1 Feb. 2, 2012

(30) Foreign Application Priority Data

Jul. 28, 2010 (JP) ..... 2010-169700

(51) Int. Cl.
*B41J 2/165* (2006.01)
*B41J 2/14* (2006.01)

(52) U.S. Cl.
CPC ..... *B41J 2/16538* (2013.01); *B41J 2/14072* (2013.01); *B41J 2002/16502* (2013.01)

(58) Field of Classification Search
None
See application file for complete search history.

(56) References Cited

U.S. PATENT DOCUMENTS 6,454,388 B1 * 9/2002 Bretl et al. ..... 347/36
2008/0024542 A1 * 1/2008 Miyazaki et al. ..... 347/20
2008/0291243 A1 11/2008 Osaki

* cited by examiner

*Primary Examiner* — Alejandro Valencia
(74) *Attorney, Agent, or Firm* — Canon U.S.A., Inc. IP Division

(57) ABSTRACT

A liquid ejection apparatus includes a liquid ejection head including: an element substrate; a first recess having inner walls including a first side surface of the element substrate, a second side surface facing thereto, and a part of a fitting surface to which the element substrate is fitted; and a second recess having inner walls including a third side surface of the element substrate, which is a rear surface of the first side surface, a fourth side surface facing the third side surface, and another part of the fitting surface; and the liquid ejection apparatus also includes a wiping member configured to move from the second recess toward the first recess to wipe the ejection port surface. The first recess is provided with a sealing material to a level higher than the level of a sealing material in the second recess, in a direction of ejecting liquid.

13 Claims, 13 Drawing Sheets

LIQUID EJECTION HEAD AND LIQUID EJECTION APPARATUS

BACKGROUND OF THE INVENTION

1. Field of the Invention

The present invention relates to liquid ejection heads and liquid ejection apparatuses for ejecting liquid.

2. Description of the Related Art

An ink-jet recording head, which is a typical liquid ejection head, and an ink-jet recording apparatus, to which the ink-jet recording head is attached, will be described. FIG. 13A is a schematic perspective view showing an ink-jet recording head 1000, and FIG. 13B is a sectional view showing a part of the cross section taken along line XIIIB-XIIIB in FIG. 13A.

The ink-jet recording head 1000 includes a substrate (hereinafter also referred to as a "recording element substrate" 1101) having a plurality of ink-ejection ports 1102 through which ink is ejected and a supporting member 1500. The recording element substrate 1101 is formed of a silicon substrate 1108, on which energy generating elements 1103 that generate energy for ejecting ink are provided, and an orifice plate 1106 having the ink-ejection ports 1102. The silicon substrate 1108 and the orifice plate 1106 are bonded together. The supporting member 1500 has an opening 1600 surrounding the recording element substrate 1101. The recording element substrate 1101 is accommodated in the opening 1600 and is bonded to the supporting member 1500. Furthermore, an electrical wiring member 1400 that is electrically connected to the recording element substrate 1101 is disposed on the top surface of the supporting member 1500 and is bonded thereto. A portion around the recording element substrate 1101, i.e., a recess between the recording element substrate 1101 and the supporting member 1500, is provided with a sealing material 2000.

If the sealing material 2000 has a high coefficient of linear expansion, a stress is generated due to expansion and contraction caused by a change in temperature in the fabrication process or a change in temperature occurring depending on the operating environment of the product. Then, as shown by arrows $\alpha$ in FIG. 13B, an external force is applied to the recording element substrate 1101. As a result, the orifice plate 1106 may be separated from the silicon substrate 1108, or the recording element substrate 1101 may be deformed or cracked.

U.S. Patent Application Publication No. 2008/0291243 discloses an ink-jet recording apparatus employing special recording-condition recovery means (hereinafter also referred to as a "recovery means"). An ink-jet recording apparatus produces fine ink droplets (ink mist) when ejecting ink from the ink-ejection ports 1102. Such ink droplets or paper dust may deposit on the ejection port surface of the recording element substrate 1101. Such ink droplets or paper dust deposited around the ejection ports 1102 may cause an ink ejection defect, which may degrade the recording quality. To counter this, typically, recovery means for removing ink droplets and dust is used, in which the ejection port surface of the recording element substrate 1101 is wiped by a wiping member made of an elastic material, such as rubber (hereinafter also referred to as "wiping"). Typically, in wiping, the recording element substrate 1101 is wiped by a single wiping member.

A possible configuration for reducing the risk of the above problem caused by an external force applied to the recording element substrate 1101 due to a stress generated by the sealing material is that the recess between the recording element substrate 1101 and the supporting member 1500 is not provided with a sealing material. However, if the recess is not provided with a sealing material, ink deposited on the ejection port surface may enter the recess between the recording element substrate and the supporting member when wiped by the wiping member, and the ink may remain in the recess. If the ink remaining in the recess falls on a sheet surface during a recording operation, the recording quality may be degraded.

SUMMARY OF THE INVENTION

The present invention reduces an external force applied to a recording element substrate due to a stress generated by a sealing material and suppresses degradation in recording quality due to wiping.

According to an aspect of the present invention, a liquid ejection apparatus includes a liquid ejection head, which includes: an element substrate having a plurality of ejection ports through which liquid is ejected, and a plurality of energy generating elements that generate energy for ejecting liquid from the ejection ports; a fitting surface to which the element substrate is fitted; a first recess having a plurality of inner walls including a first side surface of the element substrate, a second side surface facing the first side surface, and a part of the fitting surface, the first recess being recessed with respect to an ejection port surface of the element substrate having the plurality of ejection ports; and a second recess having a plurality of inner walls including a third side surface of the element substrate, which is a rear surface of the first side surface, a fourth side surface facing the third side surface, and another part of the fitting surface, the second recess being recessed with respect to the ejection port surface. The liquid ejection apparatus also includes a wiping member configured to move in a direction from the second recess toward the first recess relative to the ejection port surface to wipe the ejection port surface. The first and second recesses are provided with a sealing material, the first recess being provided with the sealing material to a level higher than the level of the sealing material in the second recess, in a direction in which liquid is ejected from the plurality of ejection ports.

With the configuration of the present invention, it is possible to reduce an external force applied to a recording element substrate due to a stress generated by a sealing material, and to suppress degradation in recording quality due to wiping.

Further features of the present invention will become apparent from the following description of exemplary embodiments with reference to the attached drawings.

DESCRIPTION OF THE EMBODIMENTS

First Embodiment

Figure 12:
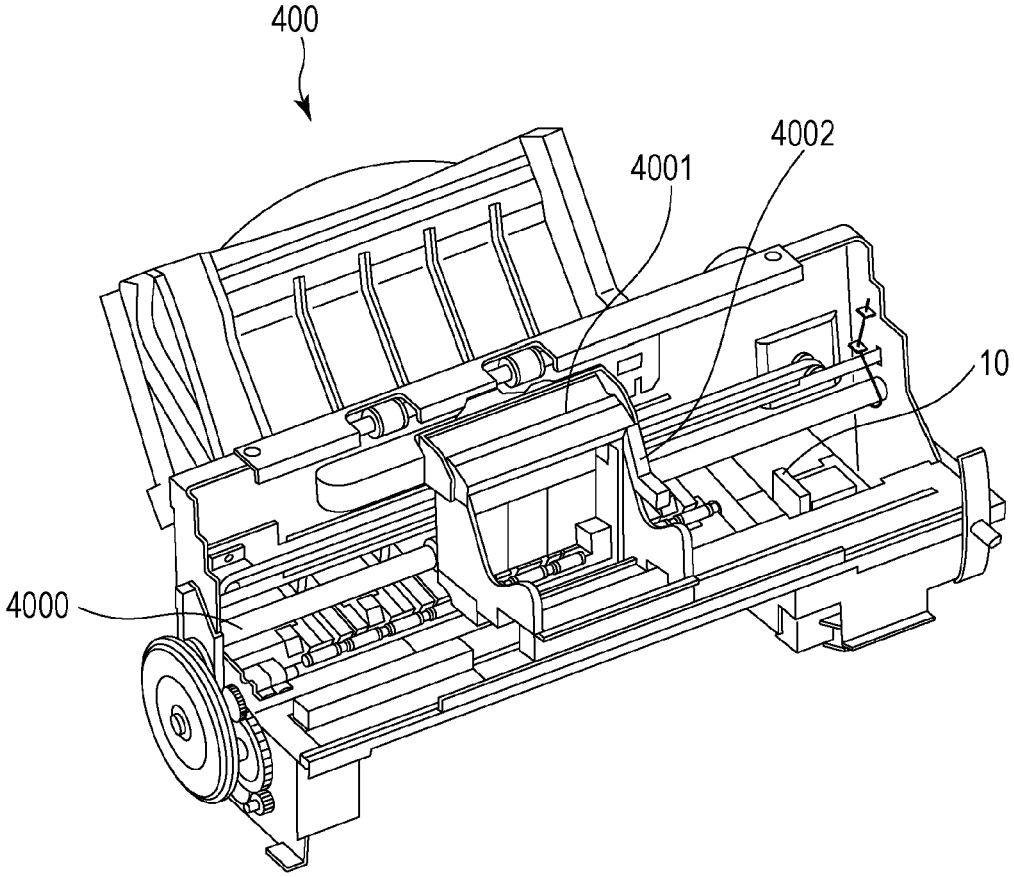
FIG. 12 is a diagram showing an ink-jet recording apparatus of the present invention.
Figure 13A:
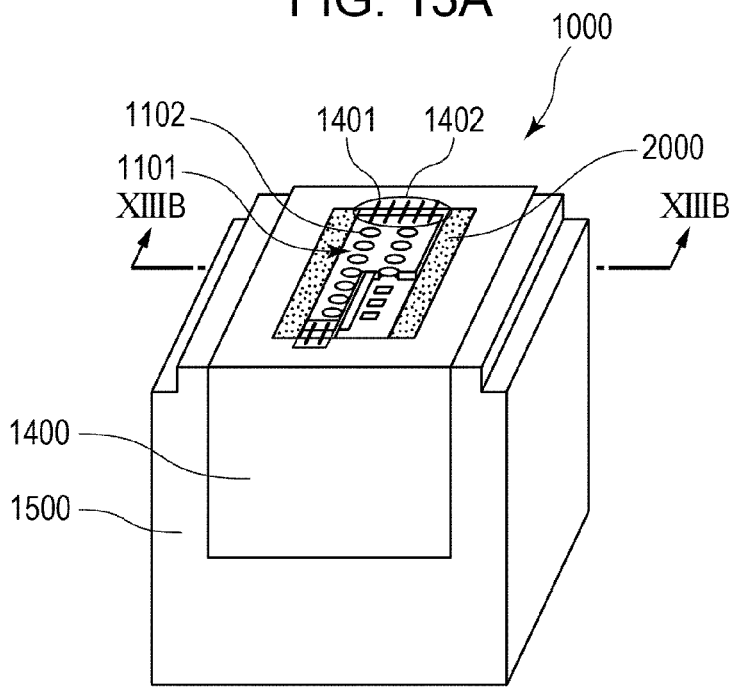
FIG. 13A is a schematic perspective view showing a conventional ink-jet recording head.
Figure 13B:
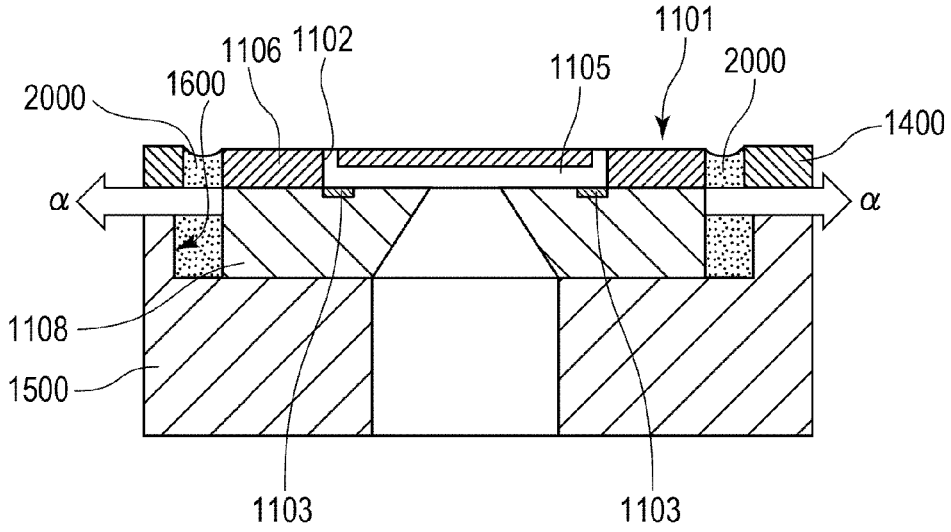
FIG. 13B is a sectional view showing a part of the ink-jet recording head.

Referring to FIG. 12, the configuration of an ink-jet recording apparatus, which is a typical liquid ejection apparatus according to a first embodiment of the present invention, will be described.

An ink-jet recording apparatus 400 includes a carriage 4001 that can be moved along a carriage shaft 4000. An ink-jet recording head H1000 is fitted in a removable manner to the carriage 4001 with a head set lever 4002. Furthermore, the ink-jet recording apparatus 400 includes a wiping member 10. The wiping member 10 moves relative to the ink-jet recording head H1000 as the carriage 4001 is moved, thereby wiping a recording element substrate H1101 and removing ink and dust.

Figure 1:
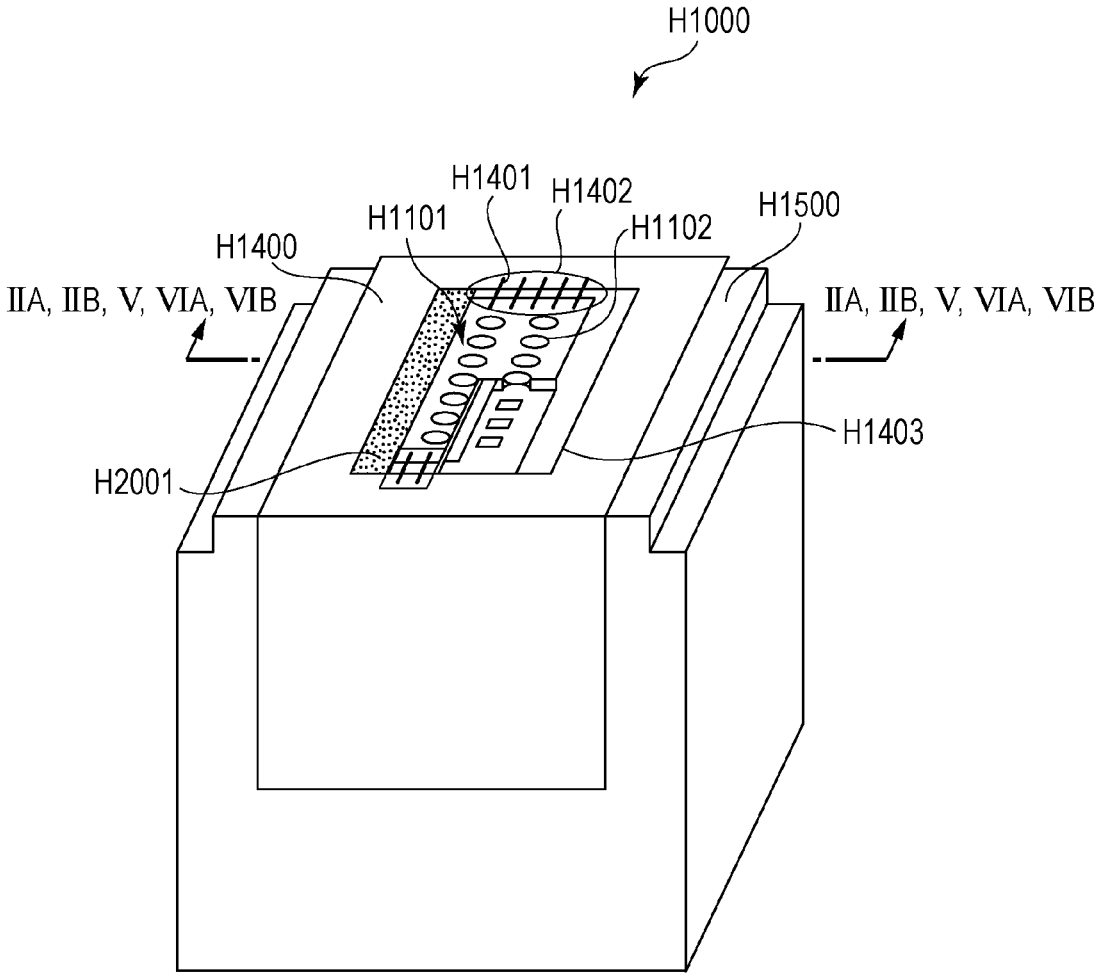
FIG. 1 is a schematic perspective view showing an ink-jet recording head according to a first embodiment of the present invention.
Figure 2A:
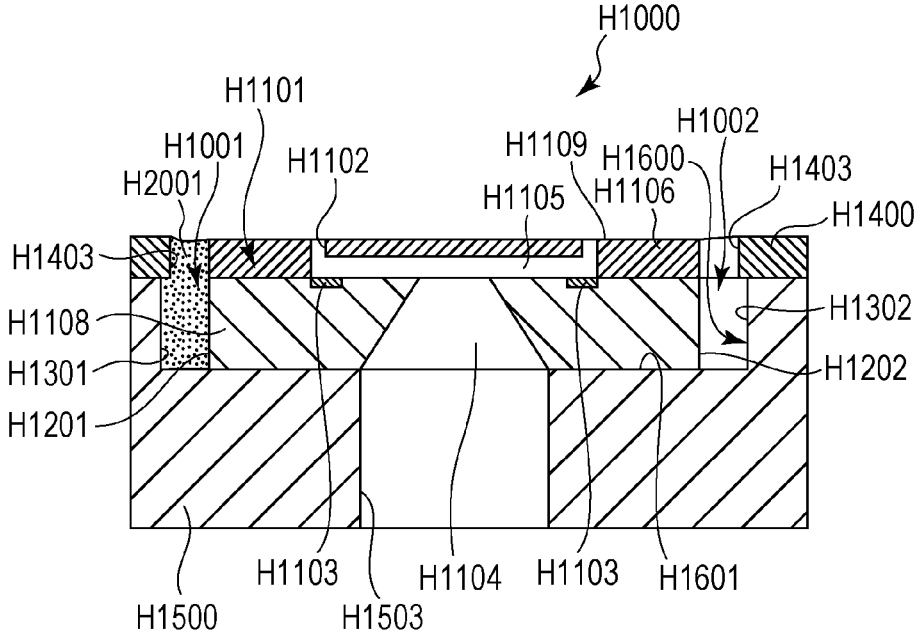
FIG. 2A is a sectional view showing a part of the ink-jet recording head according to the first embodiment.
Figure 2B:
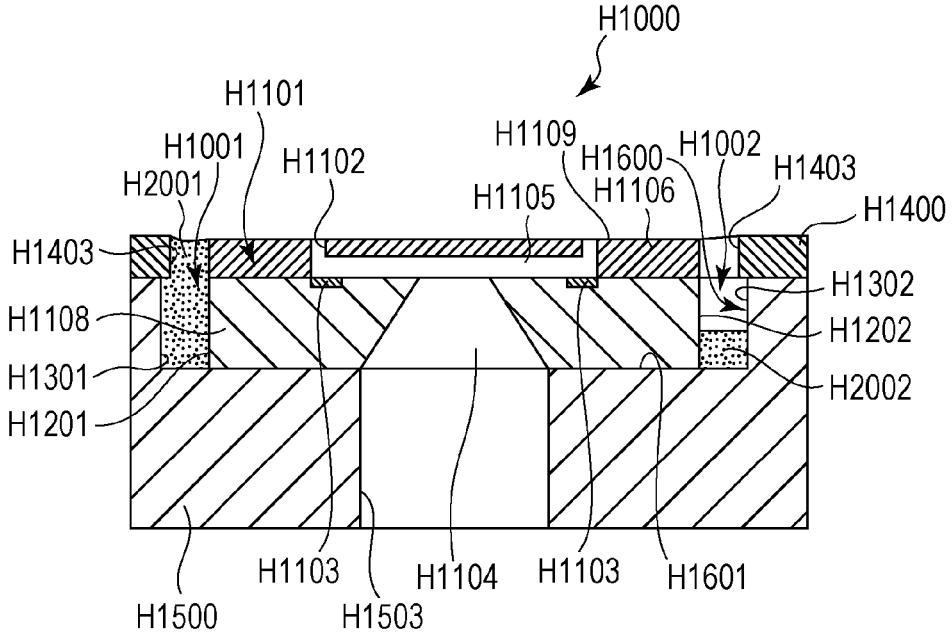
FIG. 2B is a sectional view showing a part of a modification of the ink-jet recording head according to the first embodiment.

Next, the ink-jet recording head H1000, which is a typical liquid ejection head and is fitted to the ink-jet recording apparatus 400, will be described. FIG. 1 is a schematic perspective view showing the ink-jet recording head H1000 according to the first embodiment. FIGS. 2A and 2B are sectional views showing a part of the ink-jet recording head, taken along lines IIA-IIA and IIB-IIB in FIG. 1, respectively.

As shown in FIGS. 1, 2A, and 2B, the ink-jet recording head H1000 according to this embodiment includes the recording element substrate H1101, a supporting member H1500, and an electrical wiring member H1400. The recording element substrate H1101 is accommodated in an opening H1600 provided in the supporting member H1500 and is fixed to a fitting surface H1601 of the supporting member H1500. The electrical wiring member H1400 disposed on the top surface of the supporting member H1500 has an opening H1403 surrounding the recording element substrate H1101. Furthermore, lead terminals H1401 provided on the electrical wiring member H1400 is connected to the recording element substrate H1101, whereby driving signals from the ink-jet recording apparatus 400 are transmitted to the recording element substrate H1101. Herein, a lead-terminal sealing material H1402 seals a portion provided with the lead terminals H1401 to protect the lead terminals H1401. Note that, in FIG. 1, the lead-terminal sealing material H1402 is illustrated in a see-through manner so that the lead terminals H1401 can be viewed.

The recording element substrate H1101 includes an orifice plate H1106 (an ejection port member) and a silicon substrate H1108. The silicon substrate H1108 has an elongated groove-like ink supply port H1104 extending in the longitudinal direction of the silicon substrate H1108. Heaters H1103, serving as energy generating elements that generate energy for ejecting ink, are disposed on both sides of the ink supply port H1104. The orifice plate H1106 has ejection ports H1102 and ink-flow paths H1105 formed at positions corresponding to the heaters H1103. Furthermore, electrodes that are electrically connected to the lead terminals H1401 are provided at both ends of the recording element substrate H1101 in the longitudinal direction.

In this embodiment, a first recess H1001 is a groove defined by inner walls, which are: a side surface H1201 of the recording element substrate H1101 (first side surface); a side surface H1301 of the supporting member H1500 (second side surface) facing the side surface H1201; and a part of the fitting surface H1601. A second recess H1002 is a groove defined by inner walls, which are: a side surface H1202 (third side surface), which is a rear surface of the side surface H1201 of the recording element substrate H1101; a side surface H1302 of the supporting member H1500 (fourth side surface) facing the side surface H1202, and a part of the fitting surface H1601. Furthermore, in this embodiment, a part of the opening H1403 in the electrical wiring member H1400 also defines the first recess H1001 and the second recess H1002. Note that the term "side surface" as used in this embodiment means a side surface when the ejection port surface H1109 of the recording element substrate H1101, having the ejection ports H1102, is regarded as the front.

In this embodiment, as shown in FIG. 2A, the first recess H1001 is provided with a sealing material H2001, whereas the second recess H1002 is not provided with a sealing material. In a modification of this embodiment, as shown in FIG. 2B, the first recess H1001 is provided with the sealing material H2001 to a level higher than the level of a sealing material H2002 provided to the second recess H1002, in the direction in which ink is ejected from the ejection ports H1102.

Although a detailed description will be given below, in either case, the ink-jet recording head H1000 is wiped in the direction from the second recess H1002 toward the first recess H1001.

Now, a description will be given taking the ink-jet recording head H1000 having the configuration shown in FIG. 2A as an example. However, the present invention is not limited thereto, and the same is true for the embodiments described below.

Figure 3A:
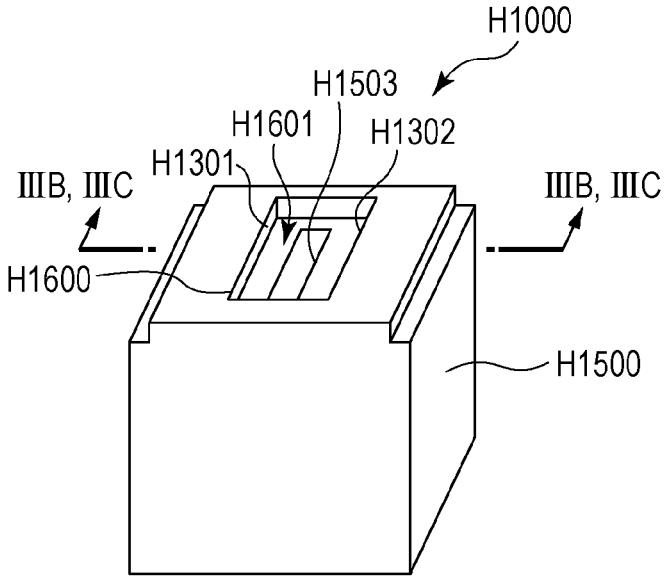
FIG. 3A is a schematic perspective view showing a supporting member according to the first embodiment.
Figure 3B:
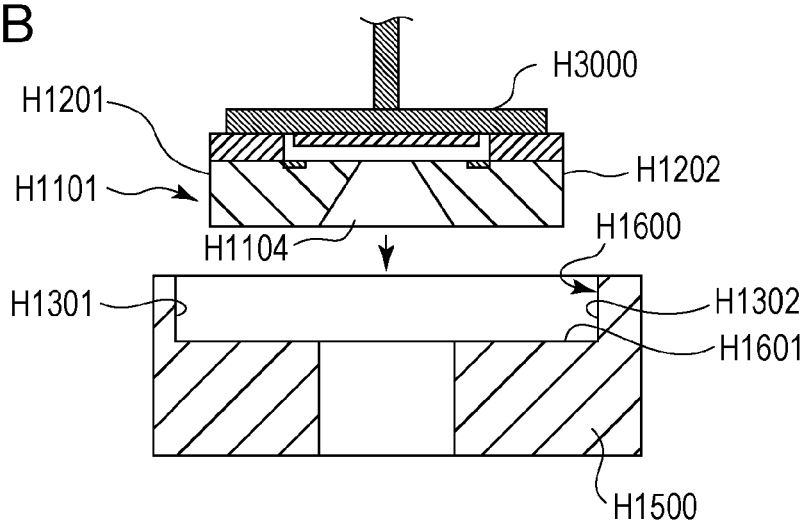
FIG. 3B is a diagram for explaining an exemplary mounting step of a recording element substrate.
Figure 3C:
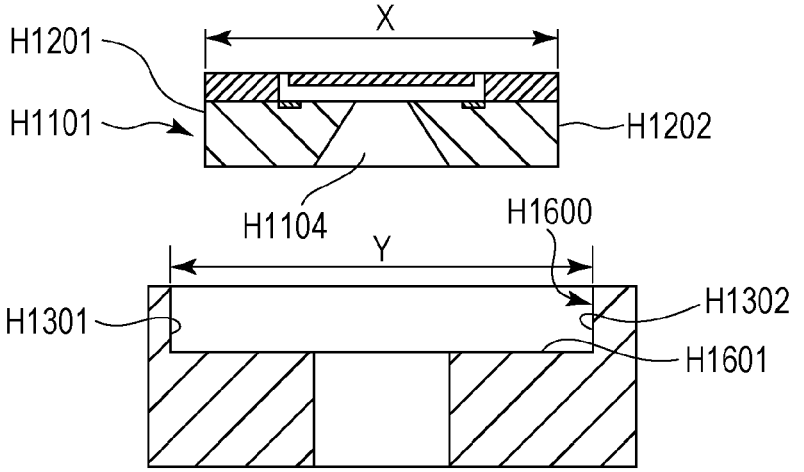
FIG. 3C is a diagram for explaining the relationship between the recording element substrate and the width of the supporting member.

Referring to FIGS. 3A to 3C, 4A, and 4B, a method of manufacturing the ink-jet recording head H1000 according to this embodiment will be described. FIG. 3A is a schematic perspective view showing the supporting member H1500. FIGS. 3B and 3C are sectional views showing a part of the supporting member H1500 and recording element substrate H1101, taken along lines IIIB-IIIB and IIIC-IIIC in FIG. 3A, respectively.

The supporting member H1500 has the opening H1600 in which the recording element substrate H1101 is to be accommodated. Furthermore, the fitting surface H1601 of the supporting member H1500, to which the recording element substrate H1101 is fitted, has an opening H1503 that communicates with the ink supply port H1104 (see FIGS. 2A and 2B) provided in the recording element substrate H1101.

FIG. 3B shows a step of mounting the recording element substrate H1101 to the supporting member H1500. For example, the recording element substrate H1101 is sucked by a suction apparatus 3000, mounted on the fitting surface H1601 of the supporting member H1500, and bonded to the fitting surface H1601.

FIG. 3C shows the relationship between the width of the recording element substrate H1101 and the width of the opening H1600 in the supporting member H1500. Because the recording element substrate H1101 is mounted as shown in FIG. 3B, the width Y of the opening H1600 in the supporting member H1500 is larger than the width X of the recording element substrate H1101 in the transverse direction, as shown in FIG. 3C. Thus, the first recess H1001 and the second recess H1002 are formed (see FIGS. 2A and 2B).

Figure 4A:
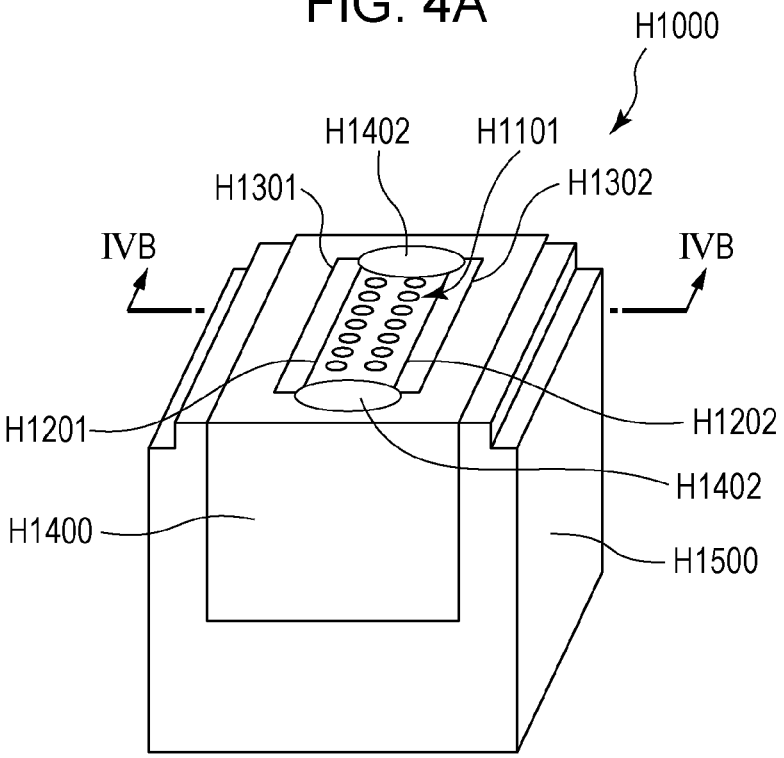
FIG. 4A is a diagram for explaining a step of applying a lead-terminal sealing material in the ink-jet recording head according to the first embodiment.

FIG. 4A is a schematic diagram showing a step of applying the lead-terminal sealing material H1402. The lead terminal H1401 for transmitting driving signals from the electrical wiring member H1400 is connected to each end of the recording element substrate H1101 in the longitudinal direction (see FIG. 1). As shown in FIG. 4A, the lead-terminal sealing material H1402 is applied to portions provided with the lead terminals H1401 to protect the lead terminals H1401. At this time, the lead-terminal sealing material H1402 not only seals the top of the lead terminals H1401, but also flows under the bottom of the lead terminals H1401, thereby sealing the gap between the recording element substrate H1101 and the supporting member H1500.

Figure 4B:
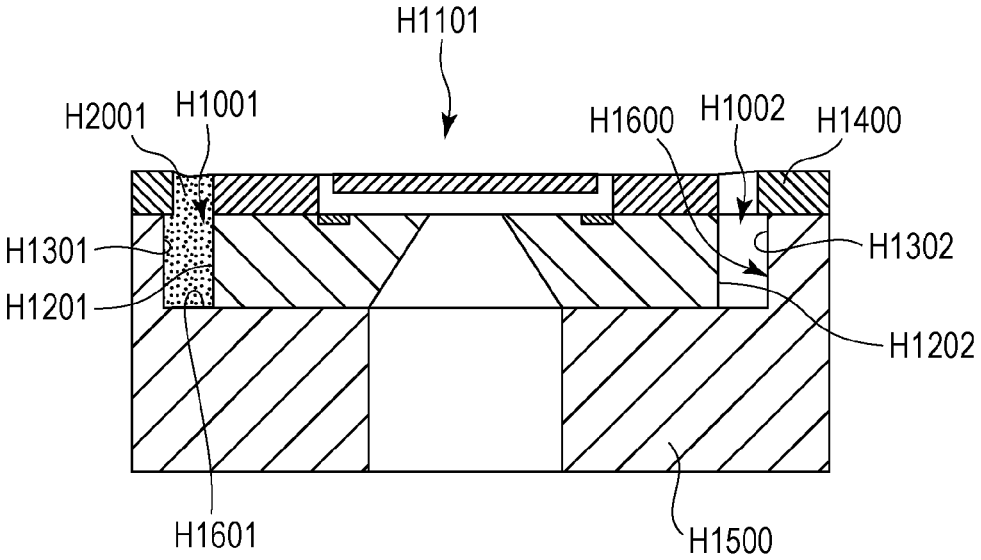
FIG. 4B is a diagram for explaining a step of applying the sealing material in a recess.

FIG. 4B is a sectional view showing a part of the cross section taken along line IVB-IVB in FIG. 4A. The sealing material H2001 is applied to the first recess H1001, which is defined by the side surface H1201 of the recording element substrate H1101, the side surface H1301 of the opening H1600 facing the side surface H1201, and a part of the fitting surface H1601, and is cured. The sealing material H2001 is not applied to the second recess defined by the side surface H1202 of the recording element substrate H1101, the side surface H1302 of the opening H1600 facing the side surface H1202, and a part of the fitting surface H1601.

Figure 5:
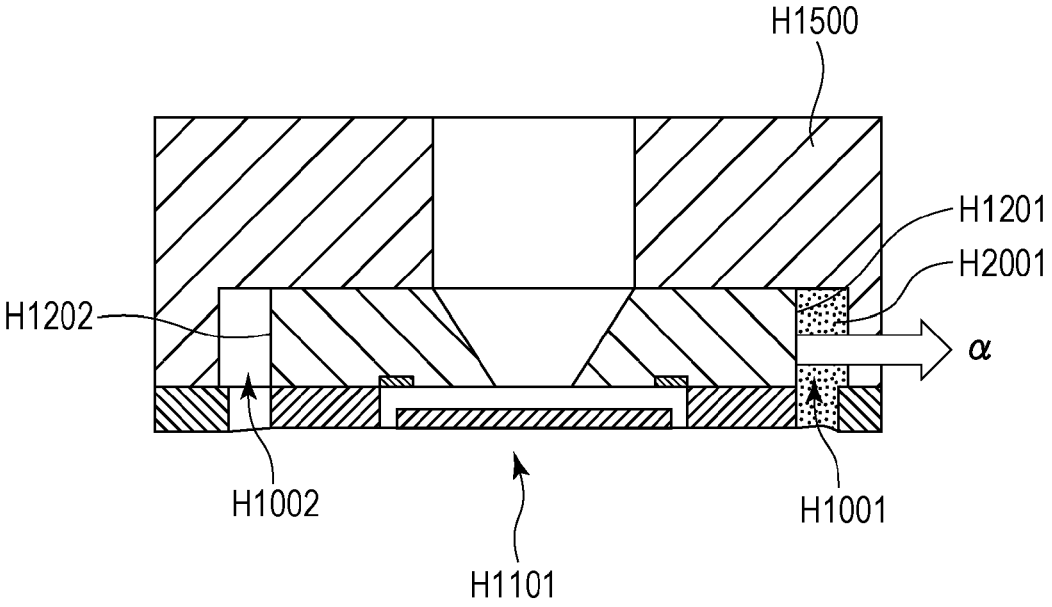
FIG. 5 is a diagram for explaining an external force applied to the recording element substrate due to a stress generated by the sealing material.

FIG. 5 is a sectional view showing a part of the ink-jet recording head 1000 taken along line V-V in FIG. 1. FIG. 5 shows a state in which a stress $\alpha$ is generated by the sealing material H2001 in the ink-jet recording head H1000 according to this embodiment shown in FIG. 2A.

In the recording element substrate H1101, the stress $\alpha$ is generated due to expansion and contraction of the sealing material caused by a change in temperature in the fabrication process or a change in temperature occurring depending on the operating environment of the product. In this embodiment, while the side surface H1201 of the recording element substrate H1101 defining the first recess H1001 provided with the sealing material is subjected to an external force, the side surface H1202 of the recording element substrate H1101 defining the second recess H1002, which is not provided with a sealing material, is less likely to be subjected to an external force. Accordingly, compared with the case where both recesses are provided with a sealing material, an external force applied to the recording element substrate H1101 can be reduced.

Furthermore, in the modification shown in FIG. 2B, the sealing material H2002 in the second recess H1002 is provided to a level lower than the level of the sealing material H2001 in the first recess H1001. In other words, the volume of the sealing material H2002 provided to the second recess H1002 is smaller than that of the sealing material H2001 provided to the first recess H1001. This configuration also contributes to a reduction in an external force applied to the recording element substrate H1101, compared with the case where both recesses are provided with a sealing material H2002.

Figure 6A:
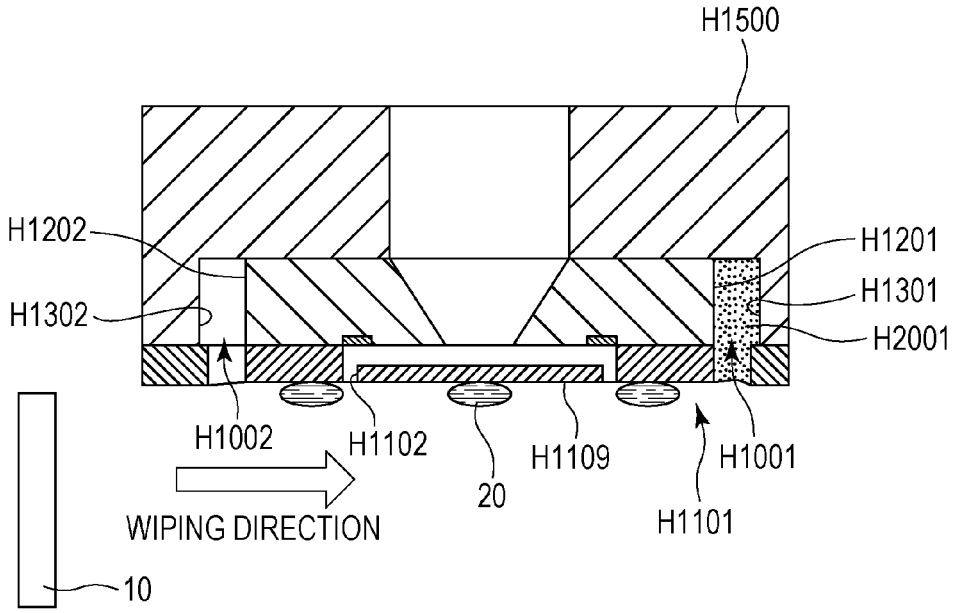
FIG. 6A is a diagram for explaining the ink-jet recording head according to the first embodiment before wiping.
Figure 6B:
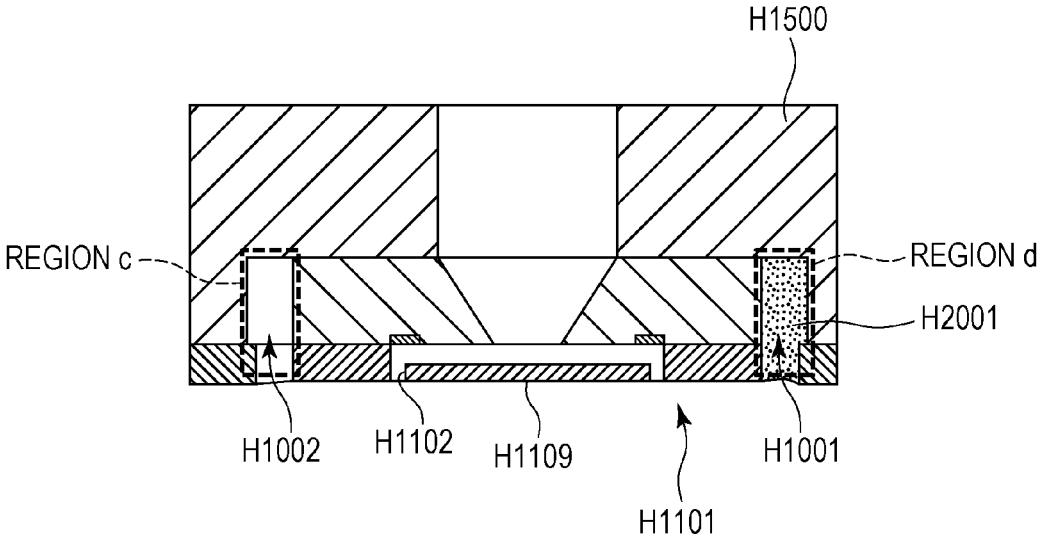
FIG. 6B is a diagram for explaining the ink-jet recording head after wiping.

FIG. 6A shows a part of the ink-jet recording head attached to the ink-jet recording apparatus 400 of this embodiment before wiping. FIG. 6B shows a part of the ink-jet recording head H1000 after wiping. FIGS. 6A and 6B show a part of the cross section taken along lines VIA-VIA and VIB-VIB in FIG. 1, respectively.

Before being wiped by the wiping member 10, ink 20 remains on the ejection port surface H1109 of the recording element substrate H1101. As shown in FIG. 6A, the wiping member 10 wipes the ink 20 off in the direction indicated by the arrow. The surface of the ink-jet recording head H1000 including the ejection port surface H1109 is wiped by the wiping member 10 in the direction from the second recess H1002 toward the first recess H1001.

The second recess H1002 located on the upstream side in the wiping direction is not provided with a sealing material or is provided with a sealing material to a level lower than the level of the sealing material provided to the first recess H1001. However, because the second recess H1002 is located on the upstream side in the wiping direction, ink 20 is less likely to be brought into a region c defined by the second recess H1002 and, thus, is less likely to remain in the region c and falls on an image during printing.

Furthermore, the first recess H1001 located on the downstream side in the wiping direction is provided with the sealing material H2001. If the first recess H1001 is not provided with a sealing material, the wiped ink 20 may be brought into the first recess H1001. However, because the first recess H1001 is provided with the sealing material H2001, ink 20 is less likely to remain in a region d, shown in FIG. 6B, and falls on an image during printing.

As has been described, with the configuration of this embodiment, an external force applied to the recording element substrate H1101 due to a stress generated by the sealing material can be reduced compared with the case where both recesses provided between the recording element substrate H1101 and the supporting member H1500 are provided with a sealing material. In addition, it is possible to reduce a risk of ink, which remains in the recesses due to wiping, falling on an image and degrading the recording quality.

In this embodiment, the supporting member H1500 has the opening H1600. However, a member separate from the supporting member H1500 and having an opening, in which the recording element substrate H1101 is disposed, may be provided on the supporting member H1500 having no opening H1600 for the provision of the recording element substrate H1101.

Second Embodiment

Figure 7A:
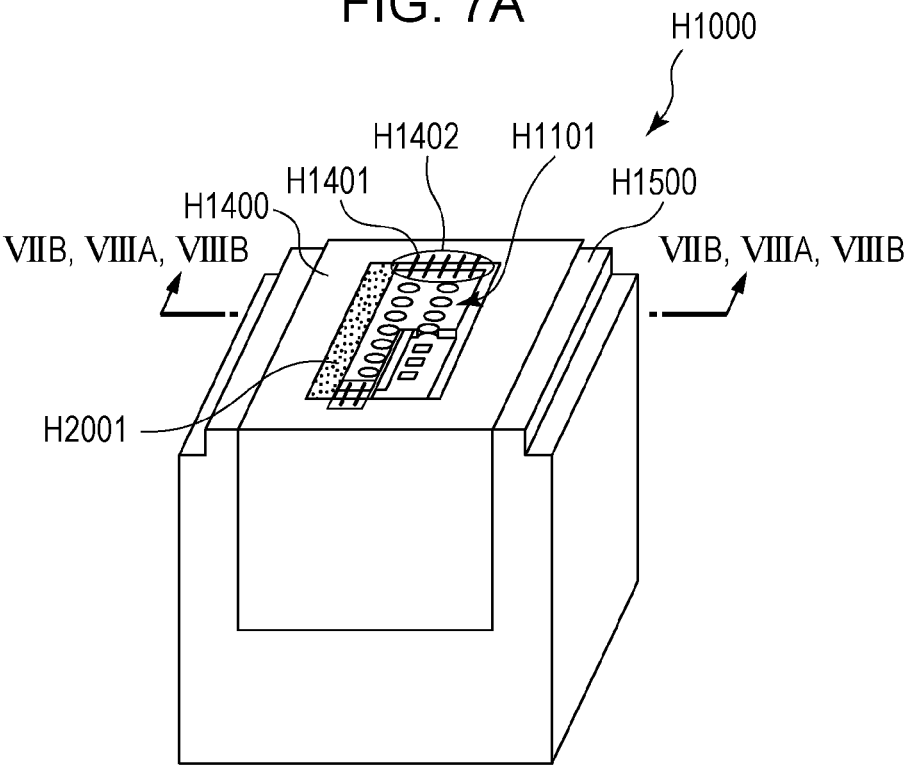
FIG. 7A is a schematic perspective view showing an ink-jet recording head according to a second embodiment of the present invention.

FIG. 7A is a schematic perspective view of an ink-jet recording head H1000 according to a second embodiment.

Figure 7B:
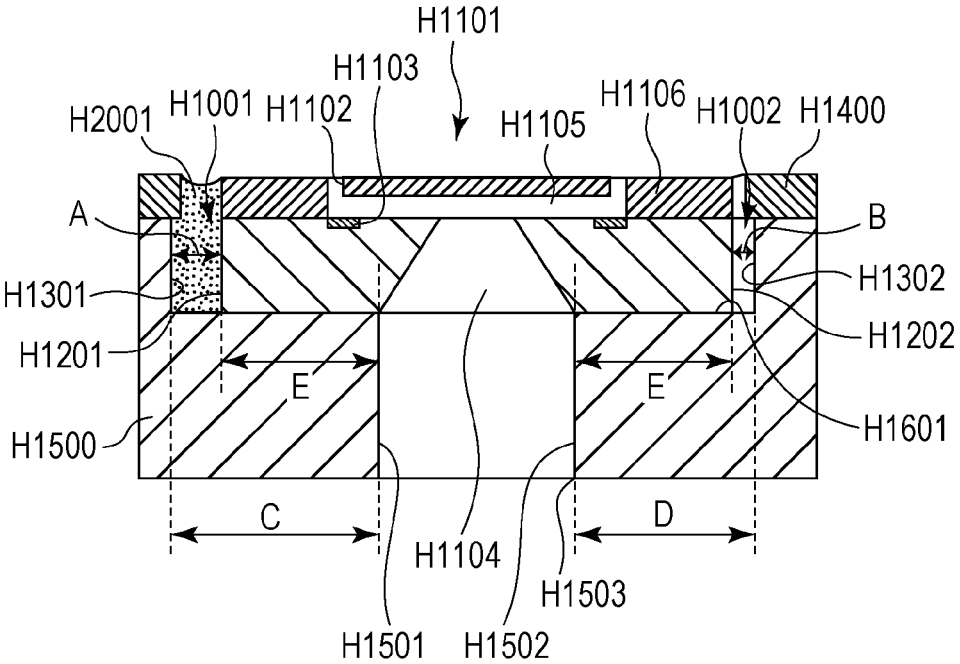
FIG. 7B is a sectional view showing a part of the ink-jet recording head according to the second embodiment.

FIG. 7B is a sectional view showing a part of the cross section taken along line VIIB-VIIB in FIG. 7A. In the following embodiments, a description for the same configurations as those of the first embodiment will be omitted.

In this embodiment, distance B between the side surface H1202 and the side surface H1302 of the second recess H1002, which is located on the upstream side in the wiping direction, is smaller than distance A between the side surface H1201 and the side surface H1301 of the first recess H1001, which is located on the downstream side in the wiping direction.

Herein, the distance between the side surface H1501 of the opening H1503, which is provided in the supporting member H1500 and communicates with the ink supply port H1104, and the side surface H1301 of the supporting member H1500, which defines the first recess H1001, is denoted by a distance C. The distance between the side surface H1502 of the opening H1503 provided in the supporting member H1500 and the side surface H1302 of the supporting member H1500, which defines the second recess H1002, is denoted by a distance D. The distance D is smaller than the distance C.

Furthermore, the distance between the ink supply port H1104 provided in the recording element substrate H1101 and the side surface H1201 of the recording element substrate H1101 is denoted by a distance E, and the distance between the ink supply port H1104 and the side surface H1202 is also denoted by a distance E, because these distances are equal.

Although the distances E are equal, because the distance D is smaller than the distance C, the distance B in the second recess H1002 located on the upstream side in the wiping direction is smaller than the distance A in the first recess H1001 located on the downstream side in the wiping direction.

Figure 8A:
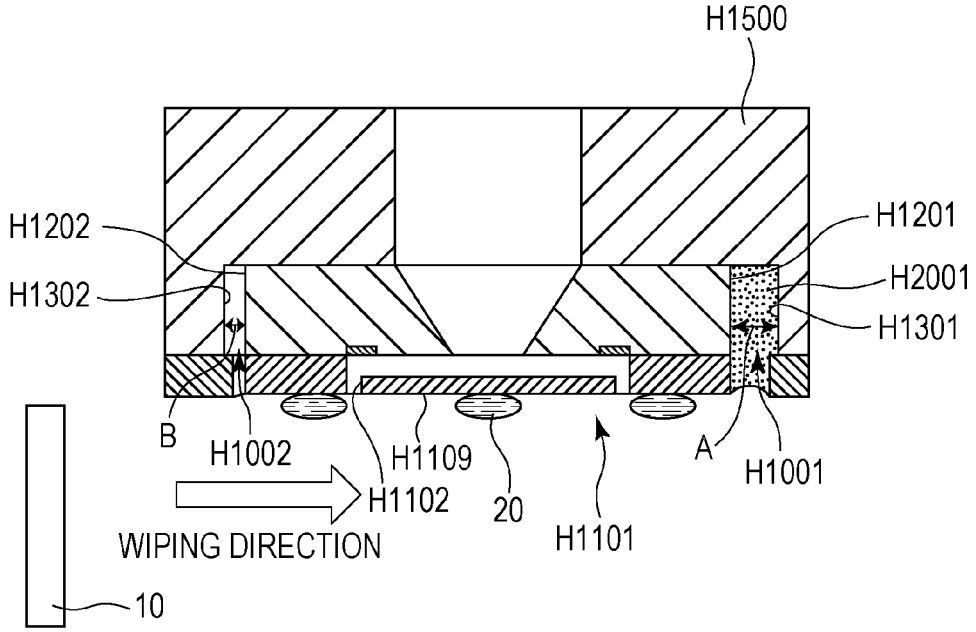
FIG. 8A is a diagram for explaining the ink-jet recording head according to the second embodiment before wiping.
Figure 8B:
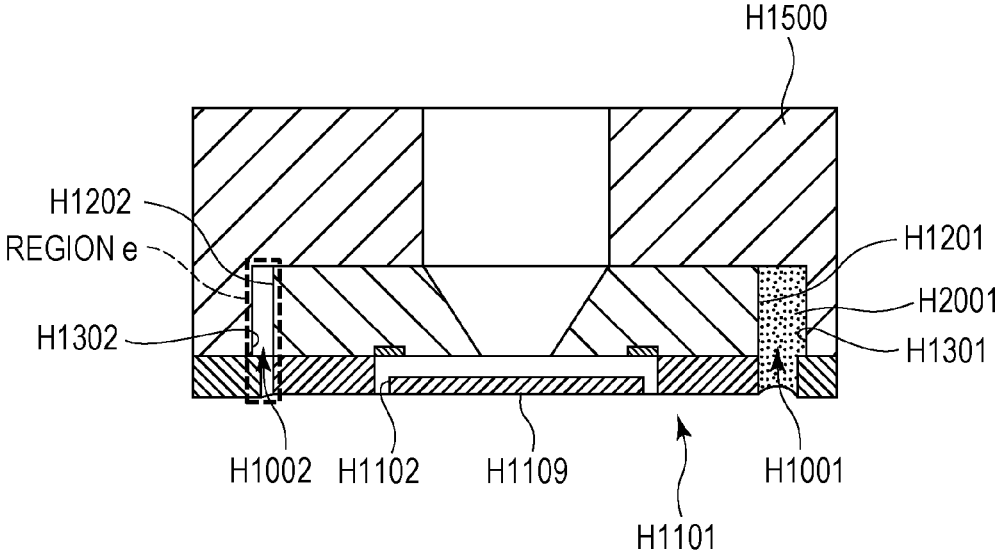
FIG. 8B is a diagram for explaining the ink-jet recording head after wiping.

FIG. 8A shows the recording element substrate H1101 according to this embodiment before wiping, and FIG. 8B shows the recording element substrate H1101 after wiping. FIGS. 8A and 8B are sectional views showing a part of the cross section taken along lines VIIIA-VIIIA and VIIIB-VIIIB in FIG. 7A, respectively. As shown in FIG. 8A, the wiping member 10 wipes the ink 20 off in the direction from the second recess H1002 toward the first recess H1001 (the direction indicated by the arrow in FIG. 8A).

The second recess H1002 is not provided with a sealing material or is provided with a sealing material to a level lower than the level of the sealing material provided to the first recess H1001. Even though a region e (FIG. 8B) is not provided with a sealing material as in this embodiment, because the distance B in the second recess on the upstream side in the wiping direction is very small, i.e., smaller than distance A, the ink 20 is less likely to be brought into the region e. Thus, a risk of degrading the recording quality can be further reduced. A smaller distance B may be more desirable.

Third Embodiment

Figure 9A:
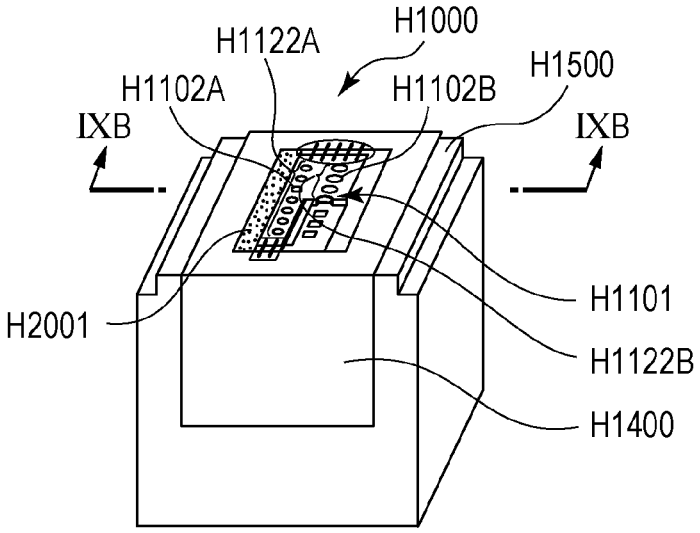
FIG. 9A is a schematic perspective view of an ink-jet recording head according to a third embodiment of the present invention.
Figure 9B:
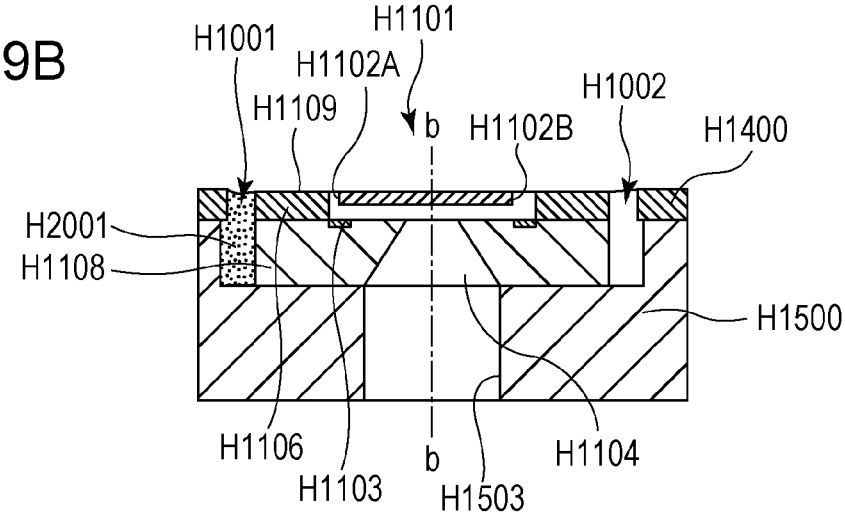
FIG. 9B is a sectional view showing a part of the ink-jet recording head.
Figure 9C:
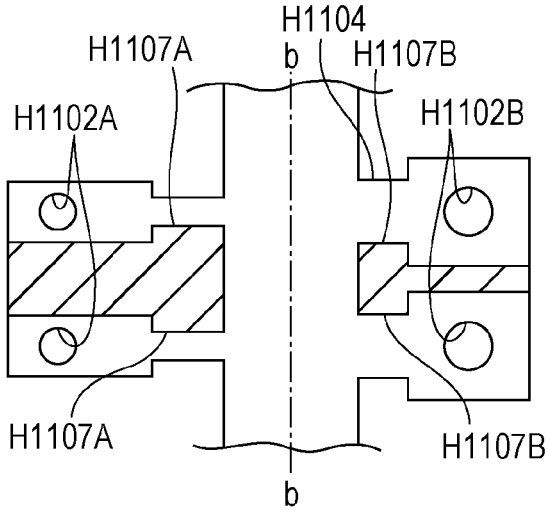
FIG. 9C is a schematic diagram showing ink-flow-path walls of the recording element substrate of the ink-jet recording head.

Referring to FIGS. 9A to 9C, a description will be given. FIG. 9A is a schematic perspective view showing an ink-jet recording head H1000 according to a third embodiment. FIG. 9B is a sectional view showing a part of the cross section taken along line IXB-IXB in FIG. 9A. FIG. 9C is a plan view of a part of the recording element substrate H1101 viewed from the ejection port surface H1109 side, in which ink-flow-path walls H1107A and H1107B are illustrated in a see-through manner.

In the recording element substrate H1101 according to this embodiment, a plurality of first ink-ejection ports H1102A constituting a first ejection port array H1122A are provided on the downstream side, in the wiping direction, of the center of the recording element substrate H1101, which is indicated by line b-b. Furthermore, a plurality of second ink-ejection ports H1102B constituting a second ejection port array H1122B are provided on the upstream side, in the wiping direction, of the center of the recording element substrate H1101. Herein, the first ink-ejection ports H1102A have a smaller diameter than the second ink-ejection ports H1102B. The ink-flow paths H1105 for the ink ejection ports having a smaller diameter are designed to have a smaller width.

Therefore, as shown in FIG. 9C, comparing the distances between ink-flow-path walls defining ink-flow paths that communicate with adjacent ink ejection ports, i.e., the widths of ink-flow-path walls, the distance between ink-flow-path walls H1107A is larger than the distance between ink-flow-path walls H1107B. Herein, the ink-flow-path walls H1107A are ink-flow-path walls that define the ink-flow paths H1105 communicating with the first ink-ejection ports H1102A. Furthermore, the ink-flow-path walls H1107B are ink-flow-path walls that define ink-flow paths H1105 communicating with the second ink-ejection ports H1102B.

Accordingly, the bonding area between the orifice plate H1106 and the silicon substrate H1108 is larger on the first ink-ejection port array H1122A side with respect to the center of the recording element substrate H1101 than on the second ink-ejection port array H1122B side with respect to the center. That is, the first ink-ejection port array H1122A side closer to the first recess H1001 provided with the sealing material H2001 is less susceptible to separation caused by a stress generated by the sealing material than the second ink-ejection port array H1122B side closer to the second recess H1002.

As has been described, in this embodiment, when the widths of the flow path walls vary among the ejection port arrays, e.g., when the diameters of the ejection ports vary, the recording element substrate H1101 is disposed such that the side surface of thereof having a larger bonding area and a greater bonding force defines the first recess H1001. This configuration reduces the risk of the recording element substrate H1101 being separated due to a stress generated by the sealing material.

Fourth Embodiment

Figure 10A:
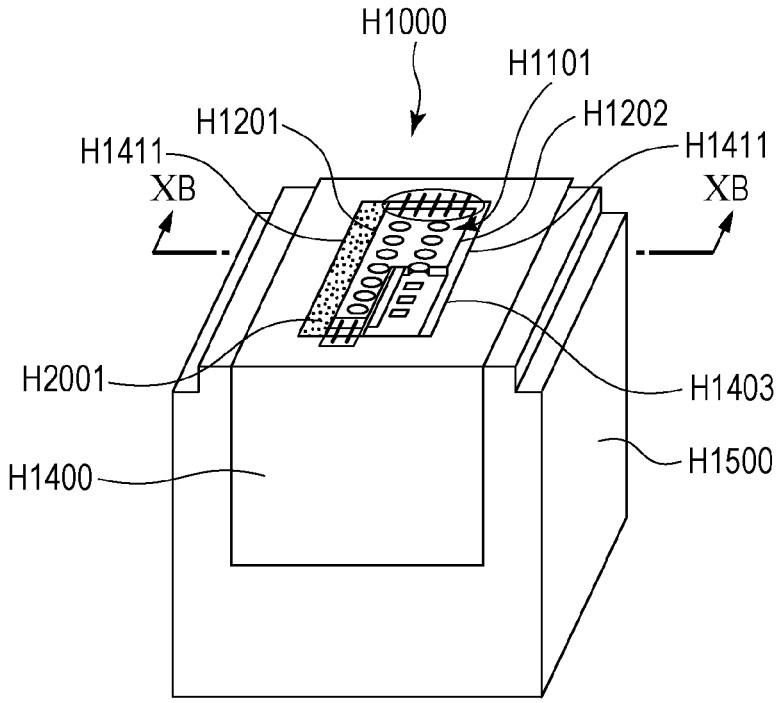
FIG. 10A is a schematic perspective view showing an ink-jet recording head according to a fourth embodiment of the present invention.
Figure 10B:
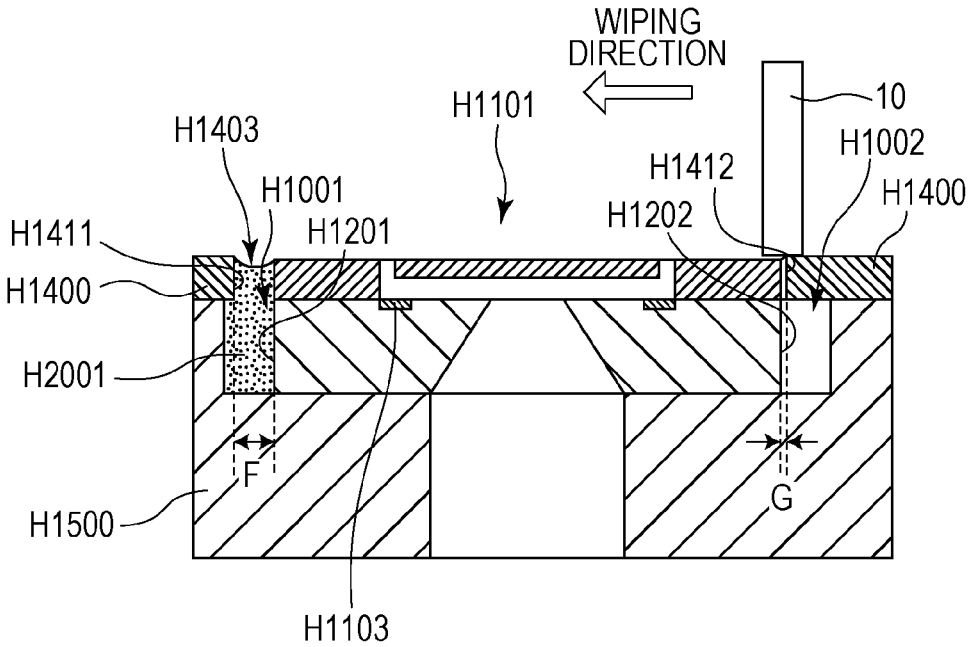
FIG. 10B is a sectional view showing a part of the ink-jet recording head.

FIG. 10A is a schematic perspective view of the ink-jet recording head H1000 according to this embodiment, and FIG. 10B is a sectional view showing a part of the cross section taken along line XB-XB in FIG. 10A. FIG. 10B also shows the wiping member 10.

Similarly to the above-described embodiment, also in this embodiment, the second recess H1002 located on the upstream side in the wiping direction is not provided with a sealing material or is provided with a sealing material to a level lower than the level of the sealing material provided to the first recess H1001 located on the downstream side in the wiping direction. A problem occurring when the distance between the recording element substrate H1101 and the electrical wiring member H1400 is large, particularly when the space therebetween is not provided with a sealing material, and when the sealing material is provided only to a low level will be described. In such cases, the wiping member 10 may come into contact with the edge of the recording element substrate H1101, damaging one or both of the wiping member 10 and the recording element substrate H1101.

To overcome this problem, in this embodiment, the distance between the side surface of the recording element substrate H1101 and the opening H1403 provided in the electrical wiring member 1400 on one side is differentiated from that on the other side. The distance between the side surface H1201 of the recording element substrate H1101 located on the downstream side in the wiping direction and a portion H1411 facing thereto constituting the opening H1403 provided in the electrical wiring member H1400 is denoted by a distance F. The distance between the side surface H1202 of the recording element substrate H1101 located on the upstream side in the wiping direction and a portion H1412 facing thereto and constituting the opening H1403 provided in the electrical wiring member H1400 is denoted by a distance G. In this embodiment, because the electrical wiring member H1400 covers the upside of the second recess H1002 over a larger area than the upside of the first recess H1001, the distance G is smaller than distance F.

This configuration reduces the risk of the wiping member 10 coming into contact with the edge of the recording element substrate H1101 and damaging the components. Furthermore, the risk of ink entering the second recess H1002 and remaining therein can be reduced. A smaller distance G is more desirable.

Furthermore, because the first recess H1001 located on the downstream side in the wiping direction is provided with the sealing material H2001, a space for a needle, if it is applied using a needle, is required. On the other hand, the second recess H1002 located on the upstream side in the wiping direction does not necessarily have to be provided with the sealing material H2002. Thus, a space for a needle for applying the sealing material does not necessarily have to be provided.

Fifth Embodiment

Figure 11A:
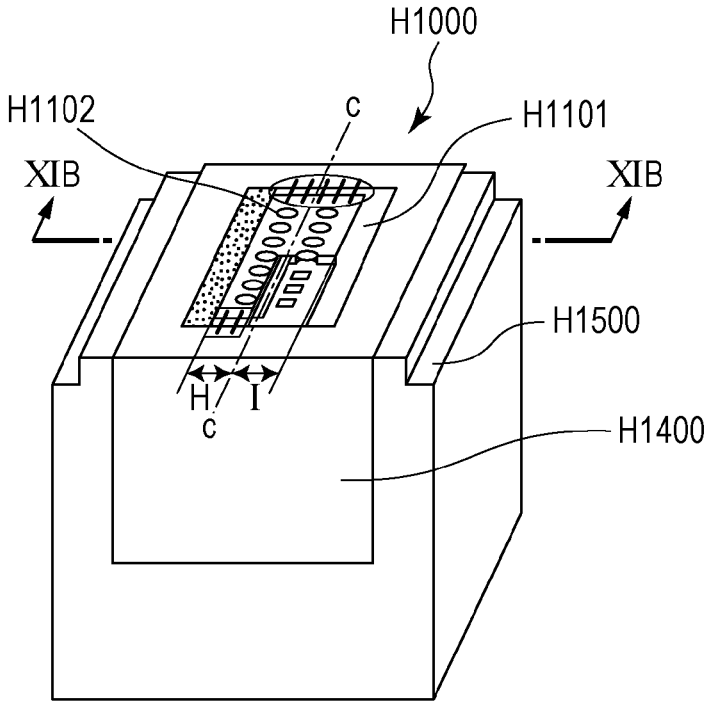
FIG. 11A is a schematic perspective view showing an ink-jet recording head according to a fifth embodiment of the present invention.
Figure 11B:
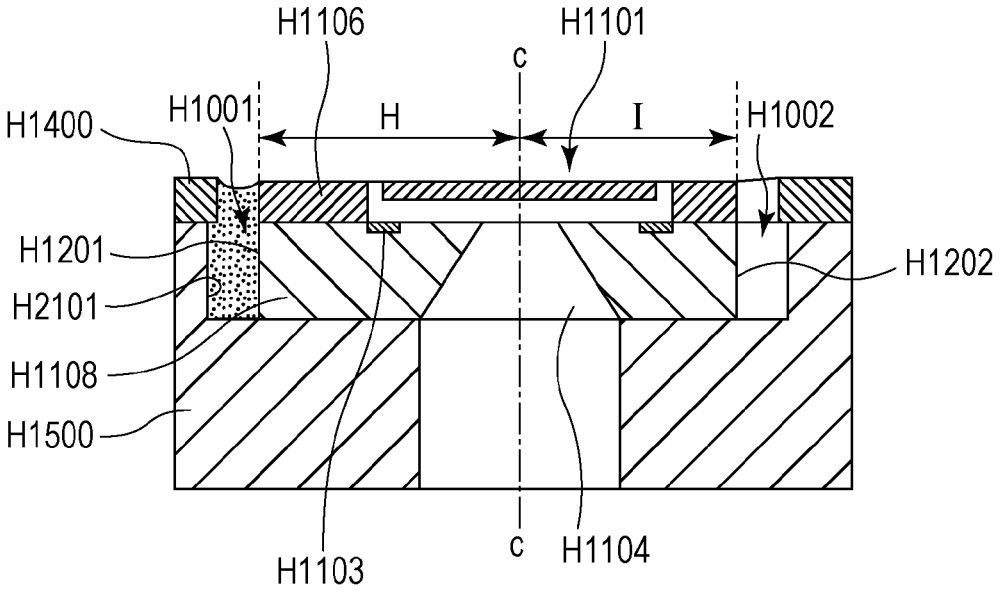
FIG. 11B is a sectional view showing a part of the ink-jet recording head.

Referring to FIGS. 11A and 11B, this embodiment will be described. FIG. 11A is a schematic perspective view showing the ink-jet recording head H1000 according to this embodiment, and FIG. 11B is a sectional view showing a part of the cross section taken along line XIB-XIB in FIG. 11A.

In the recording element substrate H1101, although the distance between the ink supply port H1104 and the side surface of the recording element substrate H1101 is preferably small from the standpoint of cost reduction, it is preferably large from the standpoint of resistance to a stress.

As shown in FIG. 11B, the distance between the center of the recording element substrate H1101, which is indicated by line c-c in FIG. 11A, and the side surface H1201 of the recording element substrate H1101 located on the downstream side in the wiping direction is denoted by a distance H. The distance between the center of the recording element substrate H1101 and the side surface H1202 of the recording element substrate H1101 located on the upstream side in the wiping direction is denoted by a distance I.

In this embodiment, distance H is larger than distance I. That is, the area of the downstream side in the wiping direction of the recording element substrate H1101, where the first recess H1001 provided with the sealing material H2001 is provided, is larger than that of the upstream side in the wiping direction, where the second recess H1002 not provided with a sealing material is provided, and thus, the downstream side has a greater strength against an external force. Furthermore, the bonding area between the orifice plate H1106 and the silicon substrate H1108 is larger on the downstream side in the wiping direction than on the upstream side in the wiping direction. Larger bonding area can reduce a risk of separation caused by an external force.

With this configuration, the cost of the recording element substrate H1101 can be reduced by reducing the size thereof, and the influence of a stress generated by the sealing material on the recording element substrate H1101 can be reduced.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2010-169700 filed Jul. 28, 2010, which is hereby incorporated by reference herein in its entirety.

What is claimed is:

1. A liquid ejection apparatus comprising:

a liquid ejection head including an element substrate having a plurality of ejection ports through which liquid is ejected, and a plurality of energy generating elements that generate energy for ejecting liquid from the plurality of ejection ports, a supporting member having a fitting surface to which the element substrate is fitted, a first recess having a plurality of inner walls including a first side surface of the element substrate, a second side surface facing the first side surface, the second side surface being a surface of the supporting member, and a part of the fitting surface, the first recess being recessed with respect to an ejection port surface of the element substrate having the plurality of ejection ports, and a second recess having a plurality of inner walls including a third side surface of the element substrate, which is a rear surface of the first side surface, a fourth side surface facing the third side surface, the fourth side surface being a surface of the supporting member, and another part of the fitting surface, the second recess being recessed with respect to the ejection port surface; and a wiping member configured to move in a direction from the second recess toward the first recess relative to the ejection port surface to wipe the ejection port surface, wherein the first recess is provided with a sealing material for preventing liquid from flowing into the first recess, and the second recess is not provided with a sealing material.

2. The liquid ejection apparatus according to claim 1, wherein the element substrate includes an ejection port member having the plurality of ejection ports, and a substrate bonded to the ejection port member and having a surface fitted to the fitting surface, and a bonding area between the ejection port member and the substrate is larger on a side of the first side surface with respect to the center of the element substrate than on a side of the third side surface with respect to the center of the element substrate.

3. The liquid ejection apparatus according to claim 1, wherein the distance between the third side surface and the fourth side surface is smaller than the distance between the first side surface and the second side surface.

4. The liquid ejection apparatus according to claim 2, wherein the element substrate includes a first ejection-port array including the plurality of ejection ports arranged along the first side surface, the first ejection-port array being provided on a side of the first side surface with respect to the center of the element substrate; a second ejection-port array including the plurality of ejection ports arranged along the third side surface, the second ejection-port array being provided on a side of the third side surface with respect to the center; and a plurality of flow paths communicating with one of the ejection ports in the first ejection-port array and the second ejection-port array, the flow paths including a part of the ejection port member and a part of the substrate, and the distance between walls defining the flow paths communicating with adjacent ejection ports of the first ejection-port array is larger than the distance between walls defining the flow paths communicating with adjacent ejection ports of the second ejection-port array.

5. The liquid ejection apparatus according to claim 4, wherein the area of the ejection ports of the first ejection-port array is smaller than the area of the ejection ports of the second ejection-port array.

6. A liquid ejection head comprising:

an element substrate having a plurality of ejection ports through which liquid is ejected, and a plurality of energy generating elements that generate energy for ejecting liquid from the plurality of ejection ports;

a supporting member having a fitting surface to which the element substrate is fitted;

a first recess having a plurality of inner walls including a first side surface of the element substrate, a second side surface facing the first side surface, the second side surface being a surface of the supporting member, and a part of the fitting surface, the first recess being recessed with respect to an ejection port surface of the element substrate having the plurality of ejection ports; and a second recess having a plurality of inner walls including a third side surface of the element substrate, which is a rear surface of the first side surface, a fourth side surface facing the third side surface, the fourth side surface being a surface of the supporting member, and another part of the fitting surface, the second recess being recessed with respect to the ejection port surface, wherein the first recess is provided with a sealing material for preventing liquid from flowing into the first recess, and the second recess is not provided with a sealing material.

7. The liquid ejection apparatus according to claim 1, wherein the distance between the center of the element substrate and the first side surface is larger than the distance between the center and the third side surface.

8. The liquid ejection apparatus according to claim 1, wherein the liquid ejection head includes an electrical wiring member having an opening surrounding the element substrate, and the electrical wiring member covering at least a part of the top opening of the first recess and the second recess and electrically connected to the energy generating elements, and the distance between the third side surface and the opening is smaller than the distance between the first side surface and the opening.

9. The liquid ejection apparatus according to claim 1, wherein the liquid ejection head includes lead terminals electrically connected to the energy generating elements, the lead terminals being connected to the element substrate, along an edge excluding edges constituting the first side surface and the third side surface of the ejection port surface.

10. The liquid ejection apparatus according to claim 1, wherein the element substrate consists of a single element substrate.

11. The liquid ejection head according to claim 6, wherein, as viewed from a direction in which liquid is ejected through the ejection ports, the first recess and the second recess each include an opening.

12. The liquid ejection head according to claim 11, further comprising a wiring member configured to transmit a signal to the element substrate, wherein the openings are not covered by the wiring member.

13. The liquid ejection head according to claim 6, wherein the third side surface of the element substrate does not contact with the sealing material.

* * * * *